United States Patent [19]

Healy

[11] 4,248,644

[45] Feb. 3, 1981

[54] EMULSION OF A MELT EXPLOSIVE COMPOSITION

[75] Inventor: Nigel A. Healy, Edenvale, South Africa

[73] Assignee: AECI Limited, Johannesburg, South Africa

[21] Appl. No.: 24,084

[22] Filed: Mar. 26, 1979

[30] Foreign Application Priority Data

Apr. 11, 1978 [ZA] South Africa ..... 78/2057

[51] Int. Cl.[3] ..... C06B 45/02

[52] U.S. Cl. ..... 149/21; 149/2; 149/45; 149/46; 149/47; 149/60; 149/61; 149/62

[58] Field of Search ..... 149/2, 60, 21, 45, 46, 149/47, 61, 62

[56] References Cited

U.S. PATENT DOCUMENTS

| | | | |
|---|---|---|---|
| 4,104,092 | 8/1978 | Mullay | 149/46 X |
| 4,134,780 | 1/1979 | Barnett | 149/46 X |

*Primary Examiner*—Stephen J. Lechert, Jr.

*Attorney, Agent, or Firm*—Cushman, Darby & Cushman

[57] ABSTRACT

An explosive composition which is in the form of a "melt-in-fuel" emulsion as defined. The melt comprises ammonium nitrate and is the discontinuous phase, while the fuel forms the continuous phase. The composition is substantially water-free and includes an emulsifying agent which imparts to it a greasy consistency. A method of making such an explosive composition.

17 Claims, No Drawings

EMULSION OF A MELT EXPLOSIVE COMPOSITION

This invention relates to an explosive composition. In particular, the invention relates to an explosive composition suitable for blasting.

According to one aspect of the invention, an explosive composition is in the form of an emulsion of a melt comprising ammonium nitrate in a fuel, the melt forming the discontinuous phase and the fuel forming the continuous phase of the emulsion, the composition including an emulsifying agent which imparts a greasy consistency to the composition, the composition being substantially water-free.

The emulsion is formed by dispersing the melt in its molten condition in the fuel, when the fuel is liquid, but the expression 'emulsion' is intended to be construed as covering also the explosive composition at temperatures below that at which the emulsion was formed, and at which the discontinuous phase may be solid or may be in the form of droplets of super-cooled liquid. By 'greasy consistency' is meant that the explosive composition is capable of extrusion at ambient temperatures, but at ambient temperatures will not flow unless subjected to some pressure.

The melt may comprise, in addition to the ammonium nitrate, at least one compound which together with the ammonium nitrate on heating forms a melt having a melting point which is lower than the melting point of ammonium nitrate. This compound may be an inorganic salt such as lithium nitrate, silver nitrate, lead nitrate, sodium nitrate, calcium nitrate, potassium nitrate, or mixtures thereof. Instead or in addition, the compound which together with the ammonium nitrate on heating forms a melt having a melting point which is lower than the melting point of ammonium nitrate may be an alcohol such as methyl alcohol, ethylene glycol, glycerol, mannitol, sorbitol, pentaerythritol, or mixtures thereof. Other compounds which can instead or in addition be used to form the melt together with ammonium nitrate may be carbohydrates such as sugars, starches and dextrins, and aliphatic carboxylic acids and their salts such as formic acid, acetic acid, ammonium formate, sodium formate, sodium acetate, and ammonium acetate. Yet further compounds which can instead or in addition be used to form melts with ammonium nitrate include glycine, chloracetic acid, glycolic acid, succinic acid, tartaric acid, adipic acid, and lower aliphatic amides such as formamide, acetamide and urea. Urea nitrate can also be used as can certain nitrogenous substances such as nitroguanidine, guanidine nitrate, methylamine, methylamine nitrate, and ethylene diamine dinitrate. Each of these substances may be used alone with the ammonium nitrate, or mixtures thereof can be used to form the melt of the ammonium nitrate, the mixtures being selected to form melts with the ammonium nitrate having suitable melting points and being substantially insoluble in the fuel chosen.

In general, the substance(s) chosen to form melts with the ammonium nitrate are selected by the criterion, in addition to costs, that they form melts with acceptably safe and low melting points, for example, within the range 80° C. to 130° C., although melts with melting points above 130° C. can be used.

The fuel is preferably a water-insoluble non-self-explosive fuel, selected from the group consisting in hydrocarbons, halogenated hydrocarbons and mixtures thereof. Conveniently, the fuel is selected from mineral oils, fuel oils, lubricating oils, liquid paraffin, microcrystalline waxes, paraffin waxes, xylene, toluene, dinitrotoluene, and mixtures thereof. A preferred mixture comprises a mixture of mineral oil and paraffin wax which forms a conveniently used and inexpensive fuel. The fuel may form from 2.5% to 25% by weight of the explosive composition, and preferably forms from 3% to 12% by weight of the composition.

Generally, emulsifiers suitable for forming emulsions of water in oil are suitable for use in imparting the greasy consistency to the explosive composition of the invention. Such emulsifiers are, for example, sorbitan sesquioleate, sorbitan monooleate, sorbitan monopalmitate, sorbitan monostearate and sorbitan tristearate. The mono- and diglycerides of fat-forming fatty acids are useful as are soyabean lecithin and derivatives of lanolin. Other suitable emulsifying agents include alkyl benzene sulphonates, oleyl acid phosphate, laurylamine acetate, decaglycerol, decaoleate, and decaglycerol decastearate. Suitable mixtures of emulsifiers may also be selected for use.

The applicant has found in practice that a suitable formulation for the composition is one in which the melt forms from 75–95% by weight of the composition, the fuel forming from 5–12% by weight of the composition, and the emulsifying agent forming from 1–10% of the composition.

Depending on the sensitivity required in the explosive composition, the composition may include a sensitizing agent. The sensitizing agent may self-explosive, non-self-explosive or a mixture of the two. Suitable self-explosive sensitizing agents are, for example, organic high explosives such as trinitrotoluene or pentaerithretol tetranitrate (PETN). Non-self-explosive sensitizing agents may comprise occluded air bubbles, gas bubbles generated in situ, or hollow particles such as hollow silicate glass spheres, urea formaldehyde microspheres, phenol formaldehyde microspheres, expanded perlite, particulate foamed polystyrene or mixtures thereof. When gas bubbles are generated in situ, they may be generated from sodium nitrate together with nitric acid, or calcium carbonate together with nitric acid. Preferably the sentizing agent comprises no more than 30% by volume of the composition.

According to another aspect of the invention, a method of preparing an explosive composition as hereinbefore described, comprises forming a melt comprising ammonium nitrate, forming a homogeneous liquid mixture of a fuel and an emulsifying agent, adding the melt to the fuel and agitating the mixture to form an emulsion which, at ambient temperatures, has a greasy consistency.

Prior to adding the melt to the fuel, the melt may be formed by heating a premix of ammonium nitrate and a compound which together with the ammonium nitrate, forms a melt at a temperature which is lower than the melting point of ammonium nitrate, a premix of the fuel and emulsifying agent also being heated, the heating of the premixes being to a temperature at which they are homogeneous liquids of a suitable viscosity for forming the emulsion. The melt is then preferably added slowly to the fuel with vigorous agitation, which agitation is then continued, with cooling, when it is desired to disperse air bubbles or hollow particulate sentizing agents into the explosive composition. The composition may then be exerted into, for example, wax-coated paper shells or low density polyethylene 'lay flat' sleeves.

The following table gives illustrative examples of compositions of the invention, and sets out the diameters in which they were detonated and the initiators used to detonate them.

TABLE

| Ingredients (Parts by weight) | Composition No. 1 | 2 | 3 | 4 | 5 | 6 | 7 | 8 | 9 |
|---|---|---|---|---|---|---|---|---|---|
| Lubricating Oil | 2,0 | 2,0 | 2,0 | 2,2 | 2,2 | 2,2 | 2,2 | 2,2 | 2,2 |
| Wax | 2,0 | 2,0 | 2,0 | 1,5 | 1,5 | 1,5 | 1,5 | 1,5 | 1,5 |
| Sorbitan sesquioleate | 2,0 | 2,0 | 2,0 | 1,5 | 1,5 | 1,5 | 1,5 | 1,5 | 1,5 |
| Soyabean lecithin | 2,0 | 2,0 | 2,0 | 1,5 | 1,5 | 1,5 | 1,5 | 1,5 | 1,5 |
| Ammonium nitrate | 64,5 | 69,7 | 61,0 | 64,9 | 59,7 | 68,4 | 67,8 | 67,8 | 67,8 |
| Sodium nitrate | 14,0 | 16,0 | — | 16,3 | 14,9 | 17,3 | 17,1 | 17,1 | 17,1 |
| Urea | 15,5 | 14,3 | — | 8,1 | 7,5 | 7,6 | — | — | — |
| Lithium nitrate | — | — | 20,0 | — | — | — | — | — | — |
| Silver nitrate | — | — | 19,0 | — | — | — | — | — | — |
| Calcium nitrate | 6,0 | — | — | — | — | — | — | — | — |
| Potassium nitrate | — | — | — | 4,0 | — | — | 4,2 | 4,2 | 4,2 |
| Lead nitrate | HV1 | — | — | — | 11,2 | — | — | — | — |
| Ammonium formate | — | — | — | — | — | — | 4,2 | — | — |
| Sodium formate | — | — | — | — | — | — | — | 4,2 | — |
| Ammonium acetate | — | — | — | — | — | — | — | — | 4,2 |
| Diameter (mm) | 50 | 50 | 32 | 32 | 32 | 32 | 32 | 32 | 32 |
| Density (Mg/m$^3$) | 1,5 | 1,20 | 1,42 | 1,20 | 1,20 | 1,20 | 1,20 | 1,20 | 1,20 |
| Initiator (g PETN) | 30 | 30 | 3,0 | 0,72 | 0,36 | 0,72 | 0,72 | 0,72 | 0,72 |

The lubricating oil used was that available from SHELL SOUTH AFRICA (PROPRIETARY) LIMITED, under the trade designation or grade 'HVI 55'; and the wax was that available from INDUSTRIAL RAW MATERIALS CORPORATION, USA, under the trade designation 'INDRAWAX 3335S'.

The above formulations, when tested, showed that the explosive compositions according to the invention having a greasy consistency and containing no water, developed substantial power which compared favourably with 'water-in-oil' emulsion-type explosives.

A further advantage of the explosive composition according to the invention is that, as it has a greasy consistency, it lends itself to easy handling during extrusion in the formation of cartridges or 'lay flat' sleeves. Furthermore, when compared with conventional ammonium nitrate/fuel oil blasting agents, the compositions according to the invention have increased density and develop increased power, while being capable of use in situations where they are exposed to water such as in wet boreholes.

When compared with slurry-type (water-gel type) blasting agents or 'water-in-oil' emulsion blasting agents, the compositions according to the present invention have a number of advantages. While the known slurry or emulsion blasting agents can be used in wet boreholes, they both employ water to form the slurry or emulsion respectively, thereby requiring fuels such as atomized aluminium or sensitizers such as flake aluminium to improve their performance, and the slurry-type blasting agents require, in addition, thickeners such as guar gum, which additional fuels, sensitizing agents and thickeners increase the cost.

In comparison, a substantial advantage of the present invention is that it provides a composition which employs no water at all. The power lost by vaporising the water and leading to unproductive steam generation, is thus eliminated, and no atomized aluminium is required to obtain satisfactory performance and inexpensive sensitizing agents can be used instead of flake aluminium.

It will be appreciated that the various constituents referred to herein for the composition according to the invention, for example in the table, are constituents in their water-free or substantially anhydrous conditions. The invention thus proposes using these constituents in their water-free form to obtain a water-free product composition, but naturally, on a commercial scale, small to negligible amounts of water may from time to time accidentally be present in the constituents, although every effort should be made to avoid such water.

The important advantage of the invention is thus that it provides a method and product involving extremely finely divided ammonium nitrate thoroughly dispersed in a suitable fuel, without the disadvantage of using water to aid in the dispersion, with the accompanying loss of performance.

With regard to salts such as lithium nitrate or calcium nitrate which can have water of crystallization or can be hygroscopic or deliquescent, provided they are substantially anhydrous when the product composition is made up, the greasy consistency of the continuous phase of the final product will resist water absorption, although some water uptake may take place after excessive storage periods. Product compositions containing such salts should thus be used within reasonable periods after mixing, and preferably as soon as possible.

I claim:

1. An explosive composition which is in the form of an emulsion of a melt comprising ammonium nitrate in a fuel, the melt forming the discontinuous phase and the fuel forming the continuous phase of the emulsion, the composition including an emulsifying agent which imparts a greasy consistency to the composition, and the composition being substantially water-free.

2. A composition as claimed in claim 1, in which the melt comprises, in addition to the ammonium nitrate, at least one compound which together with the ammonium nitrate, on heating, forms a melt having a melting point which is lower than the melting point of ammonium nitrate.

3. A composition as claimed in claim 2, in which the compound which together with ammonium nitrate forms a melt which has a melting point which is lower than the melting point of ammonium nitrate, is selected from the group of compounds consisting in lithium nitrate, silver nitrate, lead nitrate, sodium nitrate, calcium nitrate, potassium nitrate, methyl alcohol, ethylene glycol, glycerol, mannitol, sorbitol, pentaerythritol, sugars, starches, dextrins, formic acid, acetic acid, ammonium formate, sodium formate, sodium acetate, ammonium acetate, glycine, chloracetic acid, glycolic acid, succinic acid, tartaric acid, adipic acid, formamide, acetamide, urea, nitroguanidine, guanidine nitrate, methylamine, methylamine nitrate, ethylene diamine dinitrate and urea nitrate, and mixtures thereof.

4. A composition as claimed in claim 1, in which the melt has a melting point in the range 80° C.–130° C.

5. A composition as claimed in claim 1, in which the fuel is a water-insoluble non-self-explosive fuel selected from the group consisting in hydrocarbons, halogenated hydrocarbons and mixtures thereof.

6. A composition as claimed in claim 5, in which the fuel is selected from the group consisting in mineral oils, fuel oils, lubricating oils, liquid paraffin, microcrystalline waxes, paraffin waxes, xylene, toluene, dinitrotoluene and mixtures thereof.

7. A composition as claimed in claim 6, in which the fuel comprises a mixture of mineral oil and paraffin wax.

8. A composition as claimed in claim 1, whereof the fuel forms from 2.5% to 25% by weight.

9. A composition as claimed in claim 8, whereof the fuel forms 3% to 12% by weight.

10. A composition as claimed in claim 1, in which the emulsifying agent is selected from the group consisting in sorbitan sesquioleate, sorbitan mono-oleate, sorbitan monopalmitate, sorbitan monostearate, sorbitan tristearate, the mono- and diglycerides of fat-forming fatty acids, soyabean lecithin, lanolin derivatives, alkyl benzene sulphonates, oleyl acid phosphate, laurylamine acetate, decaglycerol, decaoleate, decaglycerol decastearate and mixtures thereof.

11. A composition as claimed in claim 1, in which the melt forms from 75% to 95% by weight of the composition, the fuel forming from 5% to 12% by weight of the composition, and the emulsifying agent forming from 1% to 10% of the composition.

12. A composition as claimed in claim 1, which includes a sensitizing agent.

13. A composition as claimed in claim 12, which includes a sensitizing agent which is self-explosive.

14. A composition as claimed in claim 12, which includes a sensitizing agent which is selected from the group consisting in occluded air bubbles, gas bubbles generated in situ, hollow particles and mixtures thereof, the sensitizing agent being disposed through the composition.

15. A composition as claimed in claim 12, in which the sensitizing agent comprises not more than 30% by volume of the composition.

16. A method of preparing an explosive composition as claimed in claim 1 which comprises forming a melt comprising ammonium nitrate, forming a homogeneous liquid mixture of a fuel and an emulsifying agent, adding the melt to the fuel and agitating the mixture to form an emulsion which at ambient temperatures has a greasy consistency.

17. A method as claimed in claim 16, in which, prior to adding the melt to the fuel, the melt is formed by heating a premix of ammonium nitrate and a compound which, together with the ammmonium nitrate, forms a melt at a temperature which is lower than the melting point of ammonium nitrate, a premix of the fuel and emulsifying agent also being heated, the heating of the premixes being to a temperature at which they are homogeneous liquids of a suitable viscosity for forming the emulsion.

* * * * *